US006102717A

United States Patent [19]

Aoki et al.

[11] Patent Number: 6,102,717

[45] Date of Patent: Aug. 15, 2000

[54] CAM MECHANISM FOR ATTACHING AND DETACHING INTERCONNECTING STRUCTURES WITH A LOW INSERTION FORCE

[75] Inventors: Hiroshi Aoki; Motohisa Kashiyama; Kazuhiro Watanabe; Susumu Nakatsugawa, all of Shizuoka, Japan

[73] Assignee: Yazaki Corporation, Tokyo, Japan

[21] Appl. No.: 09/009,414

[22] Filed: Jan. 20, 1998

[30] Foreign Application Priority Data

Jan. 17, 1997 [JP] Japan ..... 9-006273

[51] Int. Cl.[7] ..... H01R 13/62

[52] U.S. Cl. ..... 439/157; 439/953

[58] Field of Search ..... 439/157, 152, 439/153, 310, 953

[56] References Cited

U.S. PATENT DOCUMENTS

| | | | |
|---|---|---|---|
| 5,425,654 | 6/1995 | Colleran et al. | 439/372 |
| 5,904,583 | 5/1999 | Katsuma et al. | 439/157 |

FOREIGN PATENT DOCUMENTS

| | | |
|---|---|---|
| 4-319271 | 11/1992 | Japan . |
| 6-11275 | 2/1994 | Japan . |
| 6-140094 | 5/1994 | Japan . |
| 6-215827 | 8/1994 | Japan . |
| 7-169529 | 7/1995 | Japan . |

*Primary Examiner*—Michael L. Gellner
*Assistant Examiner*—Barry M. L. Standig
*Attorney, Agent, or Firm*—Sughrue, Mion, Zinn, Macpeak & Seas, PLLC

[57] ABSTRACT

A connector arrangement including a cam mechanism for interconnecting connector housings, in which the number of component parts is reduced and the strength is increased. The connector arrangement includes a first connector housing having a pair of support walls extending therefrom, each of the support walls having a protruding pin; a cam lever pivotally supported on each pin with the cam lever having a pair of cam grooves formed therein; a second connector including a following arm extending therefrom which includes pair of projections which are receivable in the cam grooves whereupon rotation of the cam lever causes the first and second connectors to be joined together; a temporary locking member extending from each of the support walls for retaining the cam lever in a temporary angular position at which the projections are insertable into the cam grooves; and a complete locking member extending from each of the support walls for retaining the cam lever in a completely locked angular position where the first and second connectors are completely engaged with each other. The temporary and complete locking members are integral to the support walls, respectively. The arrangement further includes rotation prevention members provided on the support walls for limiting rotation of the cam lever to a predetermined angle.

16 Claims, 6 Drawing Sheets

CAM MECHANISM FOR ATTACHING AND DETACHING INTERCONNECTING STRUCTURES WITH A LOW INSERTION FORCE

BACKGROUND OF THE INVENTION

1. Field of the Invention

The present invention relates to a mechanism for automatically attaching and detaching structures to and from each other, in which a cam mechanism is used so that a pair of structures can be automatically attached and detached with a low insertion force.

2. Background

Heretofore, an electric connector assembly in which a cam mechanism is used for fitting a pair of connectors to each other by a low insertion force has been proposed in Japanese Patent Application No. JP-A-7-169529.

In FIG. 9 of the subject application, the electric connector assembly 60 is constituted by a first connector 61, a second connector 62, and an operation lever 63. Upon rotation of the operation lever 63, the first and second connectors 61 and 62 are attached to and detached from each other through the cam mechanism.

The first connector 61 includes a receiving portion 64 for receiving the second connector 62. Also, in the first connector 61, a through-hole 65 is formed in its upper wall so as to pierce the upper wall, a pair of support walls 66 extend upwardly from the upper wall at the opposite ends of the through-hole 64 so that the operation lever 63 is pivotally supported between the pair of support walls 66, and a pair of holding arms 67 and another pair of holding arms 68 extend upwardly from the upper wall at the front and rear sides of the support walls 66. In the top end portions of the respective pairs of the holding arms 67 and 68, hooks 67*a* and 68*a* are provided to hold the operation lever 63, respectively.

The second connector 62 includes a following arm 69 protruding from an upper wall surface of the second connector 62, and a circumferential groove 70 formed in a top end portion of the following arm 69.

The operation lever 63 has a cam groove 71 formed in its front end portion so that the operation lever 63 can pivot between the two pairs of holding arms 67 and 68.

In the condition in which the top end portion of the following arm 69 passes through the through-hole 65 of the first connector 61 and in which the operation lever 63 is locked by the hooks 67*a* of one pair of holding arms 67, the circumferential groove 70 of the following arm 69 and the cam groove 71 of the operation lever 63 are engaged with each other.

After the operation lever 63 is released from the locked state by means of the hooks 67*a* of the one pair of holding arms 67, the following arm 69 is lifted up toward the first connector 61 as the operation lever 63 pivots toward the other pair of holding arms 68. When the operation lever 63 is locked by the hooks 68*a* of the other pair of holding arms 68, the second connector 62 is entirely received in the receiving portion 64 of the first connector 61 and fitted to the first connector 61. In this manner, a terminal (not shown) in the first connector 61 and a terminal (not shown) in the second connector 62 are electrically connected to each other. Conversely, for detachment of the first and second connectors 61 and 62 from each other, the aforementioned procedure is reversed.

If an external force is exerted on the operation lever 63, however, there is a risk of breaking the support walls 66 and the pair of holding arms 67 (68) because the hooks 67*a* (68*a*) for locking the operation lever 63 in the first connector 61 are provided on the holding arms 67 (68) independent of the support walls 66 pivotally supporting the operation lever 63. Furthermore, there arises a problem that the number of constituent parts increases to bring an attendant increase in the cost of the mechanism because the operation lever 63 is pivotally supported on the support walls by means of a pin 72 which is made to pass through the operation lever 63 and the support walls 66.

SUMMARY OF THE INVENTION

Upon such circumstances, it is an object of the present invention to provide a mechanism for automatically attaching and detaching structures to and from each other, in which an operation lever is pivotally supported and locked to one of a pair of structures without an increase in the number of constituent parts and in which, even if external force is exerted on the operation lever, the one structure is prevented from being broken.

In order to achieve the above object, according to an aspect of the present invention, a mechanism for automatically attaching and detaching structures to and from each other comprises: a cam mechanism for fitting one and the other structures to each other; a through-hole formed in the one structure so as to pierce the one structure; a pair of support walls formed on the one structure so as to protrude from opposite sides of the through-hole; a following arm formed so as to protrude on an outer wall surface of the other structure and so as to be inserted into the through-hole; an operation lever detachably pivoted on the support walls so as to be engaged with the following arm; and locking means formed on the support walls integrally therewith for temporarily and fully locking the operation lever.

Preferably, the support walls have rotation prevention portions for preventing the operation lever from rotating excessively.

According to another aspect of the present invention, the operation lever is detachably pivotally supported by the support walls. The support walls are relatively thick because the locking means for temporally and fully locking the operation lever are formed on the support walls integrally therewith.

According to yet another aspect of the present invention, the operation lever is prevented from rotating excessively because the rotation prevention portions are formed on the support walls.

An embodiment of the present invention will be described in the case where one of the two structures is constituted by a junction block and the other by a connector received and fitted into the junction block. Incidentally, the present invention can be applied to any other cases.

DETAILED DESCRIPTION OF THE INVENTION

FIGS. 1 to 8 show a mechanism for automatically attaching and detaching a pair of structures to and from each other according to an embodiment of the present invention.

Figure 1:
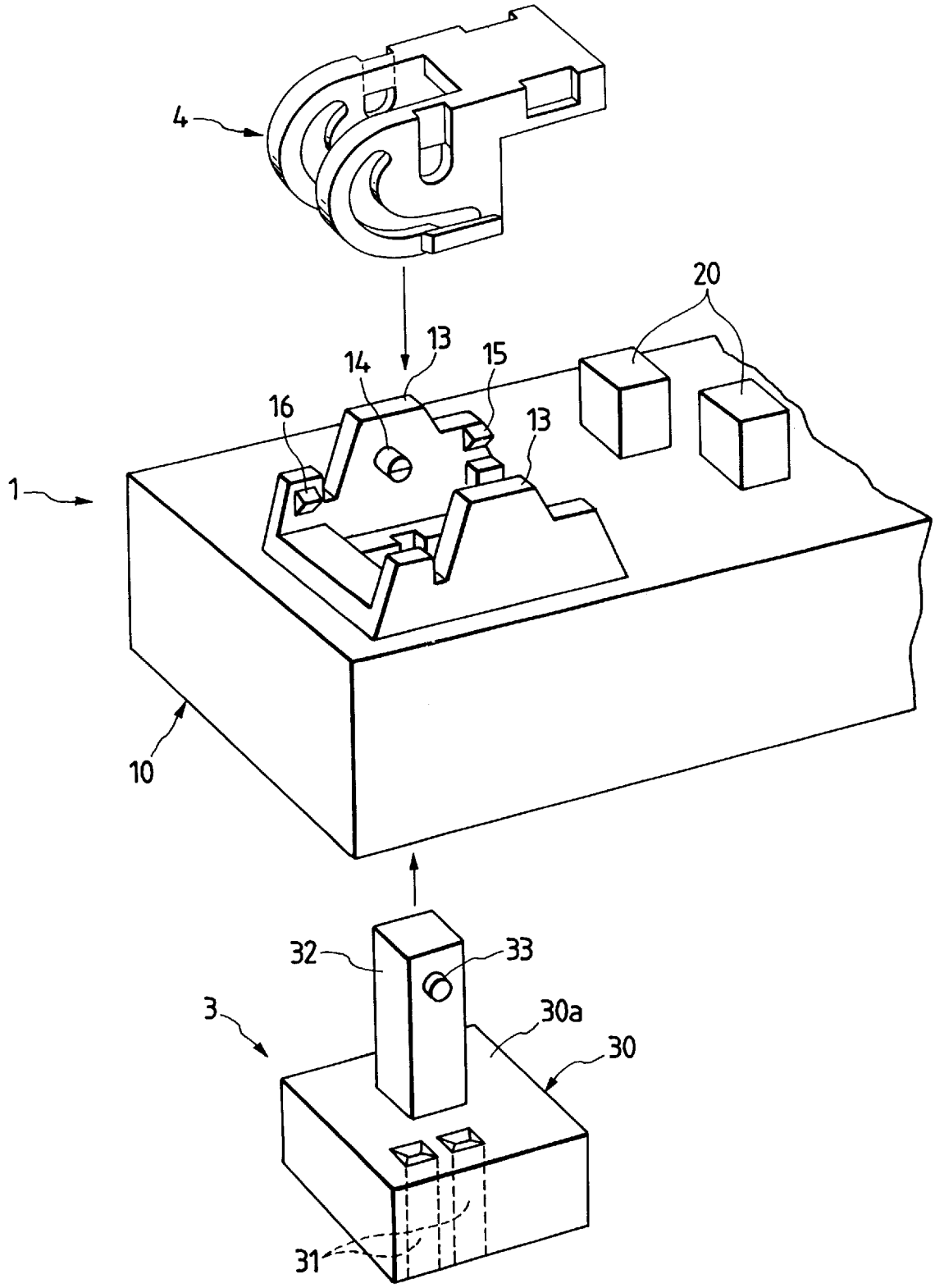
FIG. 1 is an exploded perspective view showing an embodiment of a mechanism for automatically attaching and detaching structures to and from each other according to the present invention.

In FIG. 1, this mechanism comprises a junction box 1, a connector 3 received and fitted in the junction box 1, and an operation lever 4 provided in the junction box 1. This is a mechanism for automatically attaching and detaching the junction box 1 and the connector 3 to and from each other through a cam mechanism by the rotation of the operation lever 4.

Figure 2:
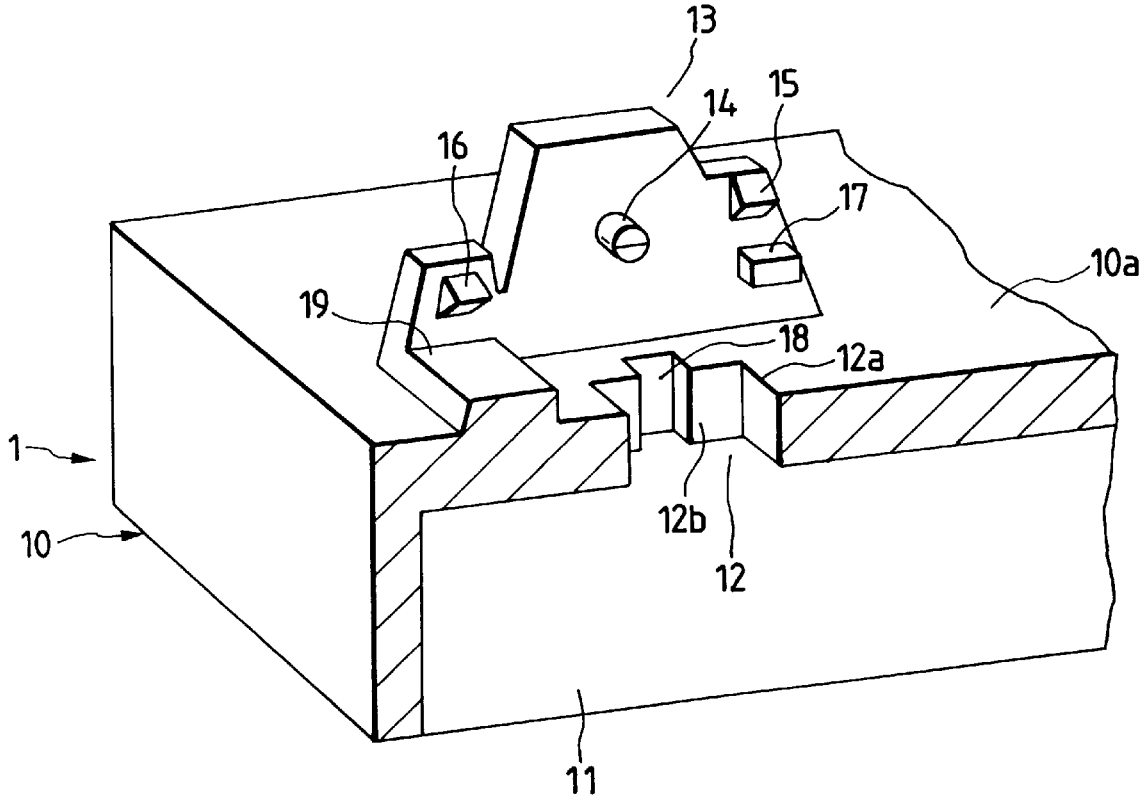
FIG. 2 is a partial sectional view of a junction box.

As shown in FIG. 2, the junction box 1 includes a receiving portion 11 for receiving the connector 3 in the inside of a box-like body portion 10. A through-hole 12 is formed in the upper wall of the junction box to form a through hole 12, a pair of support walls 13 protrude from the upper wall surface 10*a* on the opposite sides of an opening 12*a* of the through-hole 12, and a pair of support pins 14 respectively project from the pair of support walls 13 so as to face each other. Alternatively, such support pins 14 may be provided on the operation lever 4.

A pair of temporary locking portions 15 and a pair of complete locking portions 16 as locking means for temporarily and completely locking the operation lever 4 are provided on the pair of support walls 13 respectively so as to project toward each other. Further, first rotation prevention portions 17 for preventing the operation lever 4 from rotating excessively are provided on the pair of support walls 13 so as to project therefrom. On each support wall 13, the temporary locking portion 15 is disposed on one side of the support pin 14 and the complete locking portion 16 is disposed on the other side of the support pin 14. The temporary locking portion 15, the complete locking portion 16 and the first rotation prevention portion 17 are formed integrally with each support wall 13. Alternatively, these portions 15, 16 and 17 may be provided separately from the support walls 13. When the temporary locking portion 15, the complete locking portion 16 and the support pin 14 are formed integrally with each support wall 13 in the manner described above, the strength of the support wall 13 is increased because the support wall 13 are thick compared with the conventional case. Accordingly, even if external force is exerted on the operation lever, the pair of support walls 13 are prevented from being broken.

A pair of guide grooves 18 are formed in opposite inner walls 12*b* of the through-hole 12 so as to correspond to the support walls 13, respectively. A second rotation prevention portion 19 for preventing the operation lever 4 from rotating excessively is provided on the upper wall surface 10*a* of the junction box 1 and near the opening 12*a* of the through-hole 12. The first rotation prevention portions 17 are located on the temporary locking portion 15 side whereas the second rotation prevention 19 is located on the complete locking portion 16 side. In this manner, because the junction box 1 is provided with the first rotation prevention portions 17 and the second rotation prevention portion 19, the excessive rotation of the operation lever 4 is prevented. Accordingly, the respective constituent parts of the junction box 1 are prevented from being broken after the appropriate rotation of the operation lever 4. Accordingly, the operation of attaching and detaching the junction box 1 and the connector 3 to and from each other is performed speedily and securely, so that operating efficiency is enhanced.

Referring to FIG. 1, relays 20 are disposed on the upper wall surface 10*a* of the junction box 1 and terminals (not shown) from the relays extend into the receiving portion 11.

Further, the connector 3 includes a plurality of terminal receiving chambers 31 formed in the inside of a connector housing 30, a following arm 32 erected from the connector-fitting side upper wall surface 30*a*, and a pair of cam pins 33 provided at a top end portion of the following arm 32 so as to project in opposite directions.

Figure 4:
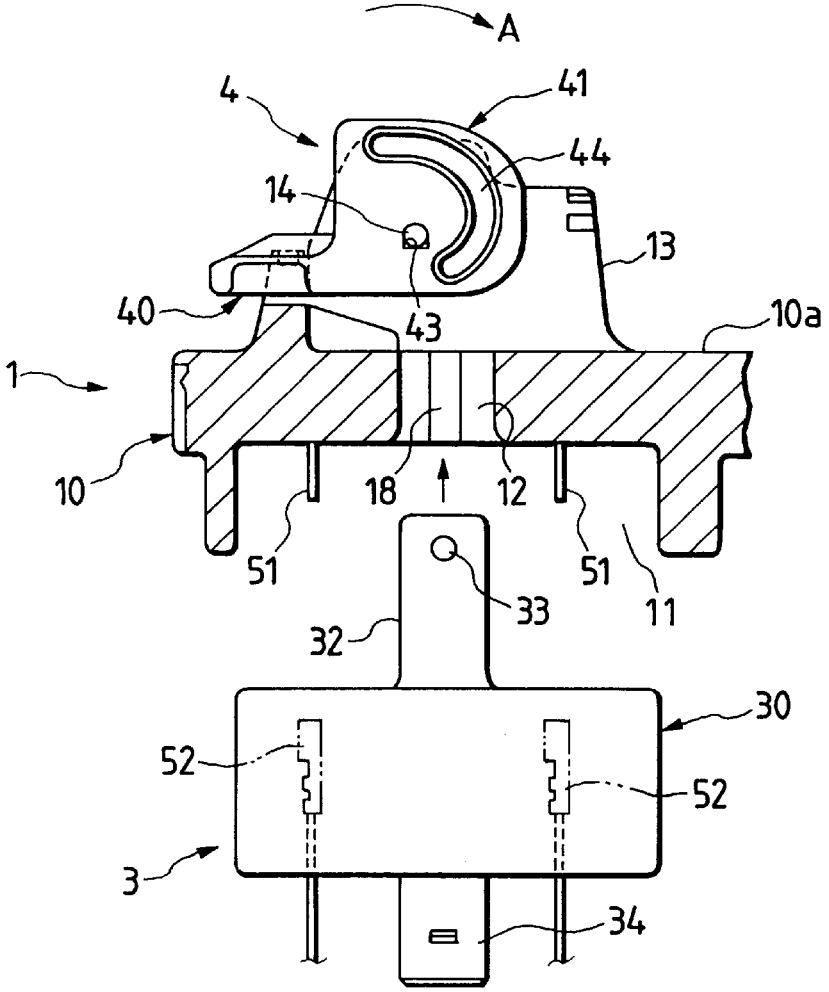
FIG. 4 is a view showing a state in which the operation lever is pivotally supported by support walls.

A grip 34 extends downwardly from the connector, as shown in FIG. 4.

Figure 3:
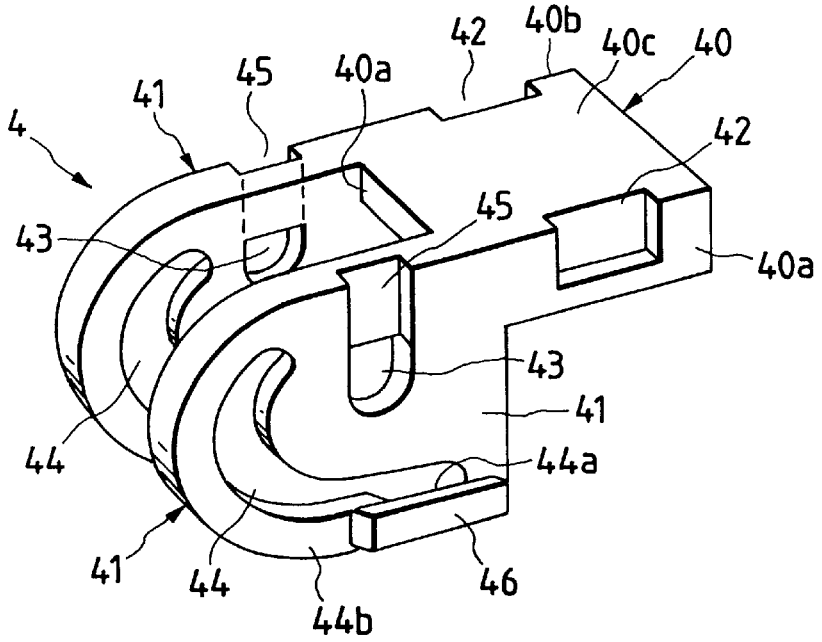
FIG. 3 is a perspective view of an operation lever.

As shown in FIG. 3, the operation lever 4 includes an operation plate portion 40, a pair of cam plate portions 41 provided at opposite ends of one side wall 40*a* of the operation plate portion 40 so as to extend perpendicular to the operation plate portion 40, cut-away locking portions 42 in opposite side walls 40*b* of the operation plate portion 40 correspondingly to the cam plate portions 41, axial holes 43 formed in the cam plate portions 41 so as to be pivotally supported by the support pins 14, and curved cam grooves 44 for guiding the cam pins 33 along the cam plate portions 41. In this manner, because the axial holes 43 of the operation lever 4 rotatably receive the support pins 14 of the support walls 13, the operation lever 4 is rotatably supported in the support walls 13 without using any other members such as pins, or the like, unlike the conventional case. Accordingly, the number of constituent parts is decreased, so that the cost of production of the junction box 1 is correspondingly decreased.

Introduction grooves 45 for introducing the support pins 14 into the axial holes 43 are formed in the cam plate portions 41. Further, an inlet portion 44*a* for introducing the cam pin 33 into the cam groove 44 is formed at an end of each of the cam grooves 44.

A stopper 46 for preventing the cam pin 33 from sliding out of the inlet portion 44*a* is disposed across the inlet portion 44*a* on the outer wall surface 44*b* side of the cam plate portion 41.

The cam mechanism in this embodiment is achieved by fitting the cam pins 33 of the following arm 3 into the cam grooves 44 of the operation lever 4.

The fitting of the connector 3 to the junction box 1 through the cam mechanism by the rotation of the operation lever 4 will be described below.

First, the relays 20 (FIG. 1), fusible links (not shown), harness terminal connectors (not shown), and so on, are disposed on the upper wall surface 10*a* of the junction box 1. Further, male terminals 51 extend into the receiving portion 11 of the junction box 1. Female terminals 52 are inserted and held in the terminal receiving chambers 31 of the connector 3.

Figure 5:
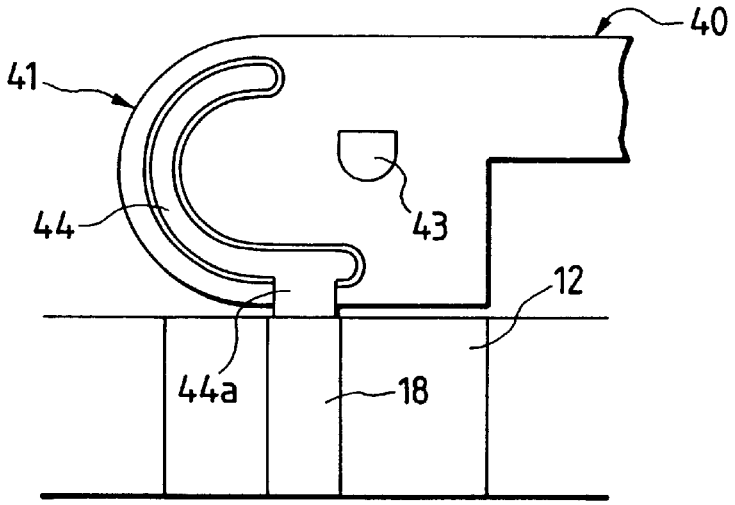
FIG. 5 is a partly enlarged view of FIG. 4.

Initially, the operation plate portion is positioned such that the upper wall surface 40*c* thereof faces the upper wall surface 10*a* side of the junction box 1, as shown in FIG. 4. In this position, the respective support pins 14 of the support walls 13 are introduced into the introduction grooves 45 of the operation plate portion 40 and fitted into the axial holes 43. After the insertion, the operation lever 4 is rotated in the direction of A in FIG. 4 about the support pins 14 of the support walls 13. When the operation plate portion 40 contacts the first rotation prevention portions 17, the locking portions 42 of the operation plate portion 40 are engaged with the temporary locking portions 15 of the support walls 13. In this position, as shown in FIG. 5, the inlet portions 44*a* of the cam grooves 44 and the guide grooves 18 of the through-hole 12 are aligned.

Figure 6:
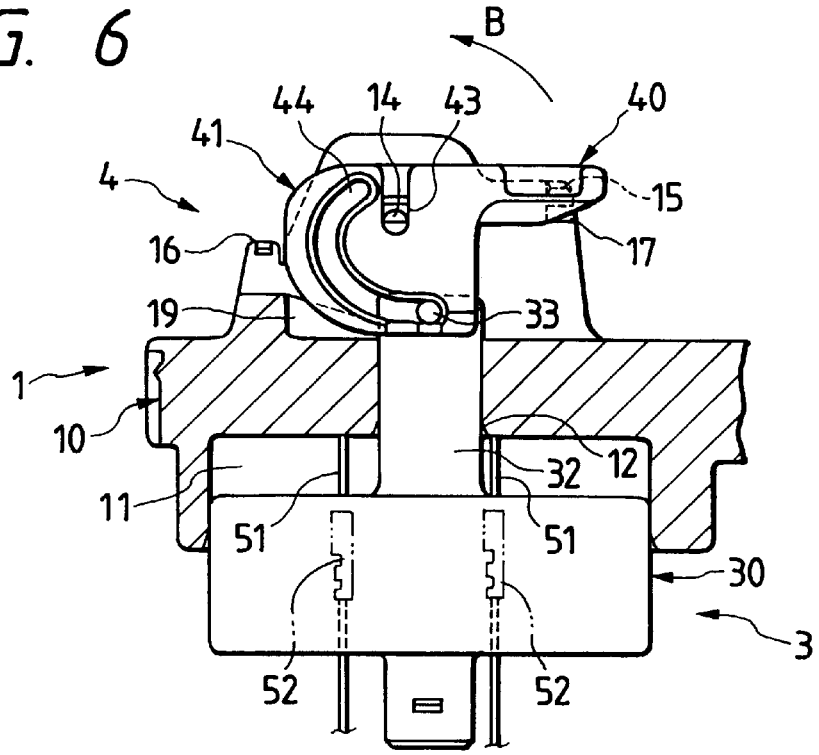
FIG. 6 is a view showing a state in which the junction box is not fitted to a connector.

Further, as shown in FIG. 6, while the operation lever 4 is kept in a temporarily locked state, the following arm 32 of the connector 3 passes through the inside of the receiving portion 11 of the junction box 1 so that the cam pins 33 of the following arm 32 pass through the guide grooves 18 of the junction box and are eventually received in the inlet portion 44*a* of the cam grooves 44.

Thus, the cam pins 33 are fitted into the cam grooves 44. In this position, the connector 3 is in a state where it is slightly inserted in the receiving portion 11 of the junction box 1.

Figure 7:
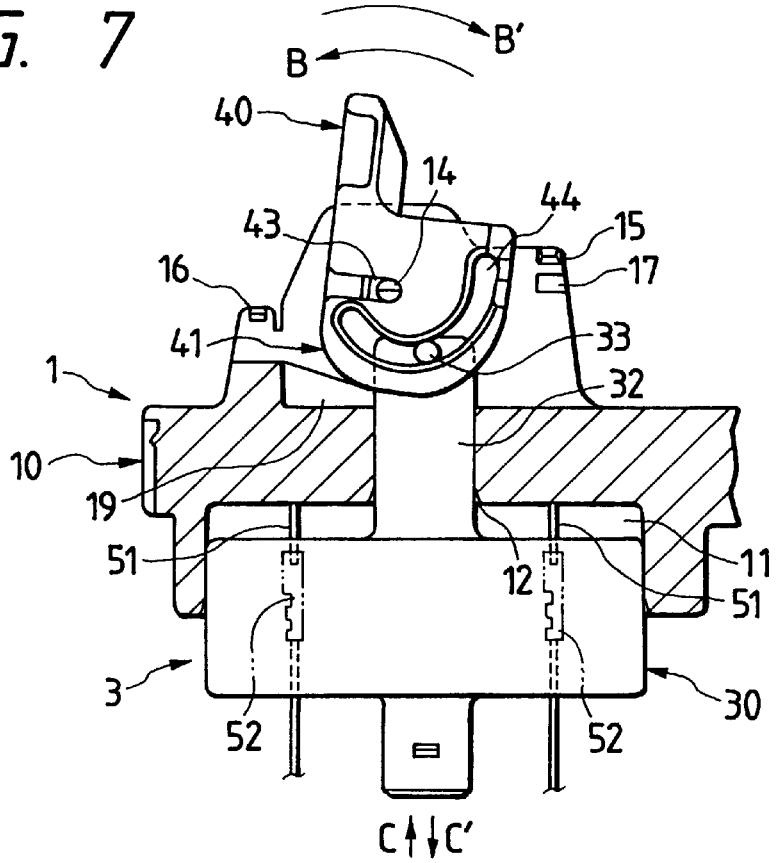
FIG. 7 is a view showing a state in which the junction box is being fitted to the connector.

When the operation lever 4 is next rotated in the direction of arrow B in FIG. 7 after the temporarily locked state of the operation plate portion 40 is released, the cam grooves 44 naturally rotate in the direction of arrow B as well. With the rotation of the cam grooves 44, the cam pins 33 lift the following arm 32 in the direction of arrow C in a gradual manner. As a result, the connector 3 is received into the receiving portion 11 of the junction box 1 gradually, so that the male terminals 51 are brought into contact with the female terminals 52 respectively in the receiving portion 11.

Figure 8:
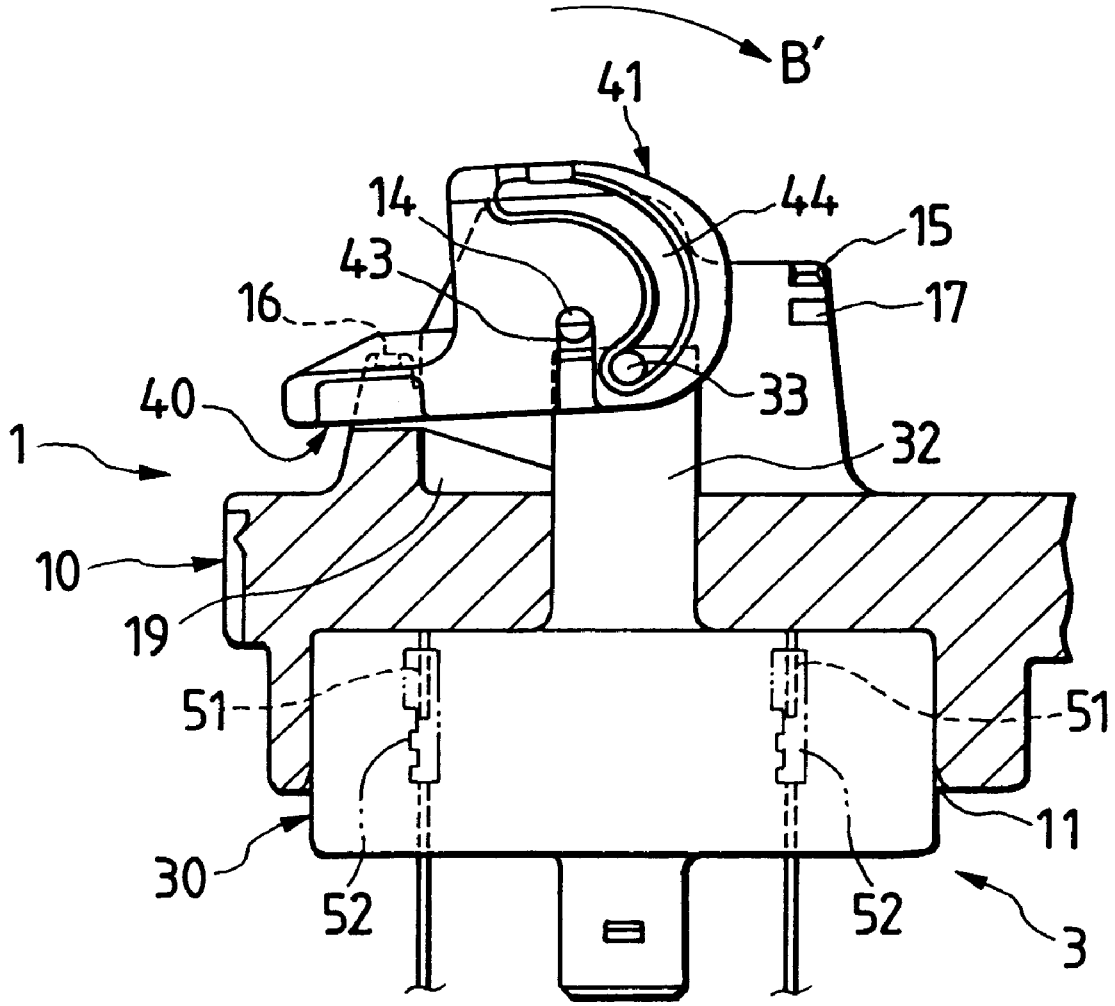
FIG. 8 is a view showing a state in which the fitting of the junction box to the connector is completed.
Figure 9:
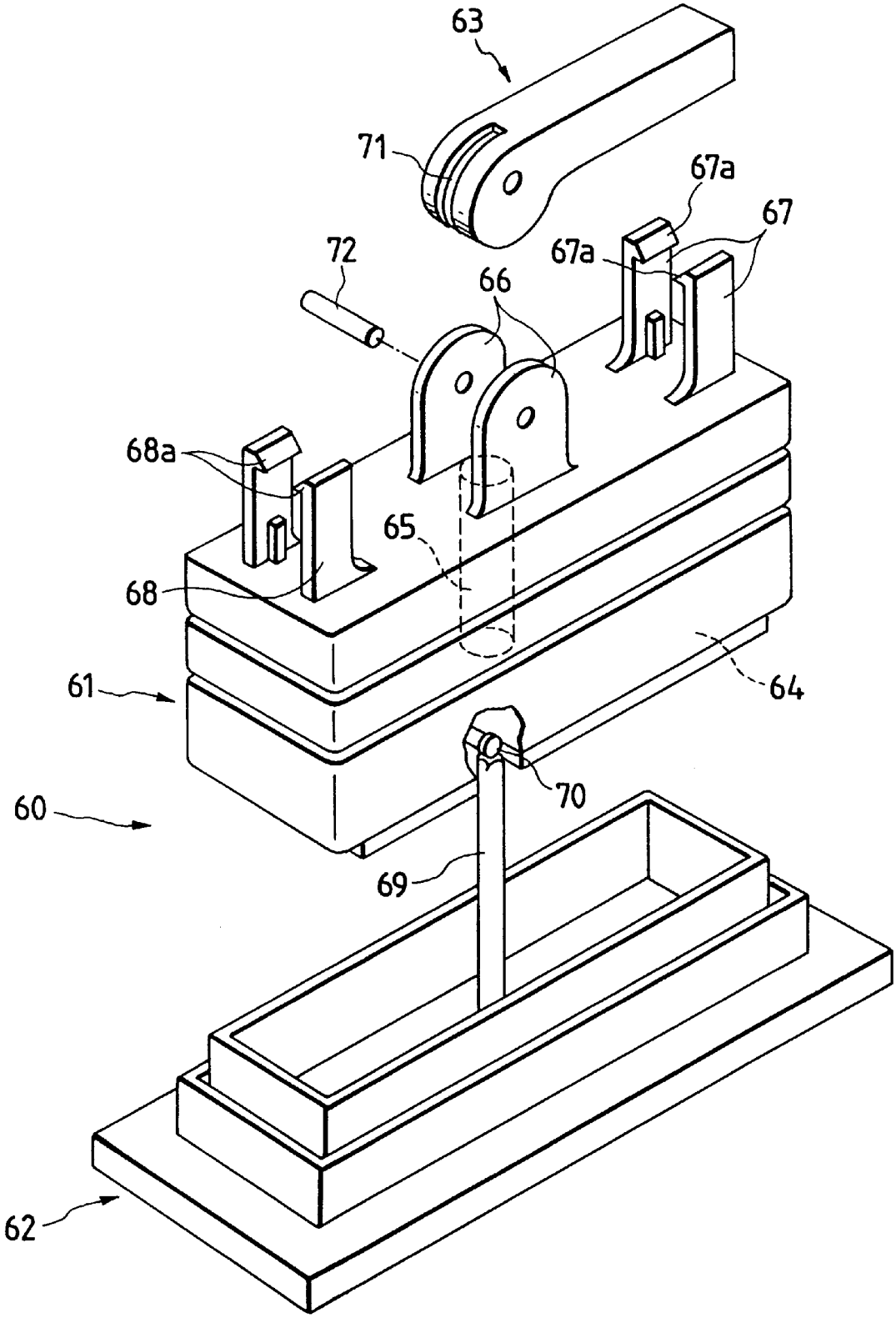
FIG. 9 PRIOR ART
FIG. 9 is an exploded perspective view of a conventional mechanism.

Finally, when the operation lever 4 is rotated so that the operation plate portion 40 contacts the second rotation prevention portion 19 as shown in FIG. 8, the locking portions 42 are engaged with the complete locking portions 16. With the fitting of the locking portions 42 to the complete locking portions 16, the connector 3 is completely lifted into the receiving portion 11 so as to be automatically fitted into the receiving portion 11. Thus, the male terminals 51 are electrically connected to the female terminals 52 respectively.

When the junction box 1 and the connector 3 fitted to the junction box 1 are to be detached from each other, the engagement (FIG. 8) of the locking portions 42 of the operation plate portion 40 with the complete locking portions 16 of the support walls 13 is released. Thereafter, the operation lever 4 is rotated in the direction of arrow B' so that the connector 3 is urged down in the direction of arrow C' by means of the cam grooves 44 and the cam pins 33. As a result, the electrical connection of the male terminals 51 to the female terminals 52 is released, as shown in FIG. 7. When the operation lever 4 is rotated in the direction of arrow B' so that the operation plate portion 40 abuts the first rotation prevention portions 17, the operation plate portion 40 is engaged with the temporary locking portions 15 as shown in FIG. 6.

When the cam pins 33 of the following arm 32 are pulled out into the receiving portion 11 via the guide grooves 18 in the condition in which the operation lever 4 is temporarily locked, the connector 3 is pulled out of the receiving portion 11. As a result, the connector 3 is automatically detached from the junction box 1. After the detachment, the operation lever 4 is rotated in the direction B so that the inlet portions 44*a* of the cam grooves 44 and the guide grooves 18 of the through-hole 12 are aligned. The operation lever 4 is then pulled out via the axial holes 43 and the introduction grooves 45. In this manner, the operation lever 4 can be attached and detached freely to and from the support pins 14 of the support walls 13.

As described above, according to the present invention, the operation lever is pivotally supported by the support walls. Because the locking means for temporarily and completely locking the operation lever are provided integrally with the support walls respectively, the support walls have an increased thickness so that the strength of the support walls is increased. Accordingly, even if external force is exerted on the support walls, the support walls are prevented from being broken. Further, because the operation lever can be pivotally supported by the support walls easily without requiring preparation of any pins as separate members on the support walls, the cost of production is reduced.

Further, because the rotation prevention portions for preventing the excessive rotation of the operation lever are formed on the support walls so that excessive force from the operation lever is prevented from being applied to the structure, the respective constituent parts of the structure are prevented from being broken.

Accordingly, the operation of turning the operation lever is performed easily, so that efficiency in the operation of attaching and detaching one structure to and from the other structure is enhanced.

What is claimed is:

1. A mechanism for automatically attaching and detaching first and second structures to and from each other, comprising:

a pair of support walls formed on said first structure and protruding from opposite sides of a through-hole formed in said first structure;

a following arm protruding from an outer wall of said second structure, said following arm being insertable into said through-hole;

a rotatable operation lever detachably pivotally supported on said support walls, said operation lever having cam grooves provided at opposite sides of one end of said operation lever for receiving said following arm to urge said first and second structures together upon rotation of said operation lever; and locking means formed on said support walls integrally therewith for temporarily and completely locking said operation lever at predetermined angular positions.

2. A mechanism for automatically attaching and detaching structures to and from each other according to claim 1, wherein said support walls have rotation prevention portions for preventing said operation lever from rotating beyond a predetermined angle.

3. A connector arrangement, comprising:

a first connector having a pair of support walls extending therefrom, each of said support walls having a protruding pin;

a cam lever pivotally supported on said each pin, said cam lever having a pair of cam grooves provided at opposite sides of one end of said cam lever;

a second connector including a following arm extending therefrom, said following arm having a pair of projections which are respectively receivable in said cam grooves whereupon rotation of said cam lever causes said first and second connectors to be joined together;

a temporary locking member extending from each of said support walls for retaining said cam lever in a temporary angular position at which said projections are insertable into said cam grooves; and a complete locking member extending from each of said support walls for retaining said cam lever in a completely locked angular position where said first and second connectors are completely engaged with each other, wherein said temporary and complete locking members are integral to said support walls, respectively.

4. The connector arrangement according to claim 3, wherein said temporary and complete locking members are unitary with said support walls.

5. The connector arrangement according to claim 3, further comprising rotation prevention means provided on said support walls for limiting rotation of said cam lever to a predetermined angle.

6. The connector arrangement according to claim 3, wherein said first connector is a junction box.

7. The connector arrangement according to claim 3, where said cam lever has a pair of introduction grooves for respectively guiding said pins into rotatable engagement with said cam lever.

8. The connector arrangement according to claim 7, wherein said cam lever is attachable to said pins by sliding said pins along said introduction grooves while said cam lever is in a predetermined angular position.

9. The connector arrangement according to claim 8, wherein said predetermined angular position is approximately 180° from said temporary angular position.

10. A connector mechanism for attaching and detaching a first structure and a second structure to and from one another, comprising:

a first structure, said first structure including a box-shaped body portion defining a receiving portion in an inner portion thereof and including a through hole formed in a wall of said box-shaped body portion opposite to an opening of said receiving portion;

a second structure, said second structure having a housing portion insertably corresponding to at least a portion of said receiving portion and a following arm protruding from an outer wall of said second structure, said following arm insertably corresponding to said through-hole and including cam pins at a top portion thereof;

a pair of substantially parallel support walls formed on said first structure and protruding from opposite sides of said through-hole;

a rotatable operation lever pivotally supported on support pins formed on said support walls, said operation lever having a plurality of substantially parallel cam plate portions, each of said cam plate portions having a cam groove for receiving a corresponding one of said cam pins; and temporary locking portions integrally formed on each of said support walls so as to project toward one another and complete locking portions integrally formed on each of said support walls so as to project toward one another, said temporary locking portions and said complete locking portions disposed on opposite sides of said support pins;

wherein said temporary locking portions and said complete locking portions are disposed to lock said operation lever at predetermined angular positions; and wherein said cam plate portions are adapted to urge said cam pins along each one of the cam grooves, correspondingly urging said housing portion of second structure into said receiving portion of said first structure, upon a rotation of said operation lever about said support pins.

11. A connector mechanism, as recited in claim 10, wherein said temporary locking portions are disposed to retain said operating lever in a first position wherein said cam pins are insertable into said cam grooves.

12. A connector mechanism, as recited in claim 11, wherein said complete locking portions are disposed to retain said cam lever in a second position corresponding to a full engagement between said receiving portion of said first structures and said housing portion of said second structure.

13. A connector mechanism, as recited in claim 12, further comprising a first rotation prevention piece and a second rotation prevention piece formed on said support walls for limiting a rotation of said operating lever.

14. A connector mechanism, as recited in claim 11, wherein said cam plate portions have introduction grooves for respectively receiving said support pins and guiding said support pins into corresponding holes in said cam plate portions.

15. A connector mechanism, as recited in claim 14, wherein said introduction grooves extend perpendicularly from an operating plate portion of said operating lever into said cam plate portions.

16. A connector mechanism, as recited in claim 15, wherein said introduction grooves are formed at one side of said cam plate portions and inlet portions of said cam grooves are formed at another side of said cam plate portions.

* * * * *